US010958025B2

(12) United States Patent
D'Addario et al.

(10) Patent No.: US 10,958,025 B2
(45) Date of Patent: Mar. 23, 2021

(54) PIVOTING PLUG ADAPTER

(71) Applicant: D'Addario & Company, Inc., Farmingdale, NY (US)

(72) Inventors: James D'Addario, Old Westbury, NY (US); Andrzej J. Krol, Wayne, NJ (US)

(73) Assignee: D'Addario & Company, Inc., Farmingdale, NY (US)

( * ) Notice: Subject to any disclaimer, the term of this patent is extended or adjusted under 35 U.S.C. 154(b) by 0 days.

(21) Appl. No.: 16/718,364

(22) Filed: Dec. 18, 2019

(65) Prior Publication Data

US 2020/0194950 A1 Jun. 18, 2020

Related U.S. Application Data

(60) Provisional application No. 62/781,231, filed on Dec. 18, 2018.

(51) Int. Cl.

| | |
|---|---|
| ***H01R 31/06*** | (2006.01) |
| ***H01R 35/04*** | (2006.01) |
| ***H01R 24/58*** | (2011.01) |

(52) U.S. Cl.
CPC ..... *H01R 31/06* (2013.01); *H01R 24/58* (2013.01); *H01R 35/04* (2013.01)

(58) Field of Classification Search
CPC ..... H01R 31/06; H01R 33/00; H01R 33/02; H01R 35/04; H01B 24/58
See application file for complete search history.

(56) References Cited

U.S. PATENT DOCUMENTS

| | | | | |
|---|---|---|---|---|
| 4,336,974 A * | 6/1982 | Wilson | H01R 39/64 439/13 |
| 6,612,874 B1 * | 9/2003 | Stout | H01R 35/00 439/11 |
| 6,786,734 B2 * | 9/2004 | Yu | H01R 35/02 439/11 |
| 6,893,267 B1 * | 5/2005 | Yueh | H01R 35/04 439/8 |
| 6,991,467 B1 * | 1/2006 | Cheng | H01R 31/06 439/10 |
| 7,128,615 B1 * | 10/2006 | Liao | H01R 31/06 439/640 |

(Continued)

FOREIGN PATENT DOCUMENTS

WO 2015045032 A1 4/2015

*Primary Examiner* — Oscar C Jimenez
(74) *Attorney, Agent, or Firm* — Alix, Yale & Ristas, LLP

(57) ABSTRACT

A pivoting plug adapter provides a conductive connection between first and second plugs. The adapter includes a pair of sub-assemblies attached to one another in a pivotal mechanical connection with each sub-assembly housing conductive elements. One plug extends from one sub-assembly and the other plug extends from the other sub-assembly. A central conductive sleeve extends between the respective sub-assemblies coaxial to the axis of rotation. A bias member is positioned between sub-assemblies to bias them away from one another. Another bias member is positioned within a sub-assembly as a member of the conductive path between the plugs. One or more of the bias members may be wave washers. The sub-assemblies are pivotal about the central axis to vary the position of the plugs relative to one another while maintaining conductive communication.

19 Claims, 9 Drawing Sheets

(56) References Cited

U.S. PATENT DOCUMENTS

| | | | | |
|---|---|---|---|---|
| 7,172,428 | B2 * | 2/2007 | Huang | H01R 35/00 439/11 |
| 7,789,711 | B2 * | 9/2010 | Wu | H01R 24/68 439/640 |
| 7,815,471 | B2 * | 10/2010 | Wu | H01R 24/58 439/640 |
| 8,096,820 | B2 * | 1/2012 | Lyu | H01R 35/04 439/141 |
| 8,226,419 | B2 * | 7/2012 | Fonzo | H01R 35/02 439/11 |
| 8,348,685 | B2 * | 1/2013 | Liao | H01R 31/06 439/131 |
| 8,777,671 | B2 * | 7/2014 | Huang | H01R 35/04 439/640 |
| 9,401,574 | B2 * | 7/2016 | Liao | H01R 35/04 |
| 10,411,418 | B2 | 9/2019 | Schmidt et al. | |
| 10,454,225 | B2 * | 10/2019 | Wilfer | H01R 13/405 |
| 2012/0322275 | A1 * | 12/2012 | Li | H01R 39/643 439/13 |
| 2016/0134071 | A1 * | 5/2016 | Toh | H01R 35/04 439/13 |

* cited by examiner

FIG. 5 -PRIOR ART

PIVOTING PLUG ADAPTER

CROSS-REFERENCE TO RELATED APPLICATION

This application claims priority to U.S. Provisional Patent Application No. 62/781,231 for Pivoting Plug Adapter, filed on Dec. 18, 2018, the entire content of which is incorporated herein by reference.

BACKGROUND OF THE DISCLOSURE

The present disclosure relates to a signal plug adapter. More particularly, the disclosure relates to a signal plug adapter for transmitting an audio signal with a pivoting arrangement between a first side and second side.

Audio signal cables and adapters have been used for many years for musical instrument amplification, sound reinforcement and high fidelity signal transmission. These adapters are typically coaxial, with a central signal conductor surrounded by insulation, a ground conductor, and a covering.

In certain contexts within which audio components are positioned very closely to one another, it is preferable to have an adapter for connecting adjacent components that omits a lengthy cable. One such context is in effects pedals used for altering the sound characteristics of instruments (usually electric guitars). Users will connect the output of one effects pedal to the input of the next pedal in a chain of effects pedals that a guitarist or other instrumentalist may use to create various different sound effects or alterations. Such effects pedals are usually foot actuated and commonly mounted with numerous other pedals on a "pedal board." An adapter cable can be used to connect adjacent pedals to one another, with preference to short cables due to the proximity of the pedals. There is no standardization with regards to the size and shape of effects pedals.

If the respective input and output jacks of adjacent pedals were always aligned with one another and/or users had no desire to move pedals, then a straight coupler could be used to connect adjacent pedals. But most pedal jacks do not align like this, requiring users to use cables to interconnect the pedals.

No matter how short the cable, there is usually a build-up of cable wire between pedals that must be managed, creates an unappealing aesthetic appearance and may prevent pedals from being mounted very close to each other. In an effort to replace cables, manufacturers have created flatter patch plugs that have very low profile, right angle plugs and flat cable so that the user can mount his pedals much closer together. These lower profile options carry drawbacks, including poor adjustability for use with pedals having a variety of input and output locations.

It would thus be useful to provide a plug adapter with a low profile within which the locations of the plugs are adjustable.

SUMMARY

In one embodiment, a signal plug adapter includes a first sub-assembly with a first conductive plug and a second sub-assembly a second conductive plug. The second sub-assembly is connected to the first sub-assembly in a pivoting relationship about an axis A of rotation. A conductive pathway extends between the first conductive plug and the second conductive plug. Pivoting of the first and second sub-assemblies about the axis A adjusts the location of the plugs relative to one another.

In another embodiment, a signal plug adapter comprises a first sub-assembly with a first laterally extending body and a first conductive plug extending therefrom and a second sub-assembly comprising a second laterally extending body with a second conductive plug extending therefrom. The first laterally extending body is pivotally connected to the second laterally extending body at a lateral position removed from the second conductive plug. The first and second conductive plug are in communicative contact with one another and a conductive pivot spacer extends between the first sub-assembly and second sub-assembly defining an axis A of rotation. A conductive bias member is positioned along the axis A and provides an axial bias force and conduction of a signal between the respective plugs.

In yet another embodiment, a signal plug adapter includes a first sub-assembly comprising a first conductive plug and a second sub-assembly comprising a second conductive plug that is connected to the first sub-assembly in a pivoting relationship about an axis A of rotation. A conductive pathway extends between the first conductive plug and the second conductive plug. A first bias member biases the first sub-assembly away from the second sub-assembly substantially along the axis A and is in constant contact with both of the first and second sub-assemblies. A second bias member is positioned within one of the first sub-assembly or the second sub-assembly substantially along the axis A, and forms part of in conductive pathway. Pivoting of the first and second sub-assemblies about the axis A adjusts the location of the plugs relative to one another.

BRIEF DESCRIPTION OF THE DRAWINGS

Aspects of the preferred embodiment will be described in reference to the drawings, where like numerals reflect like elements.

DETAILED DESCRIPTION

Figure 1:
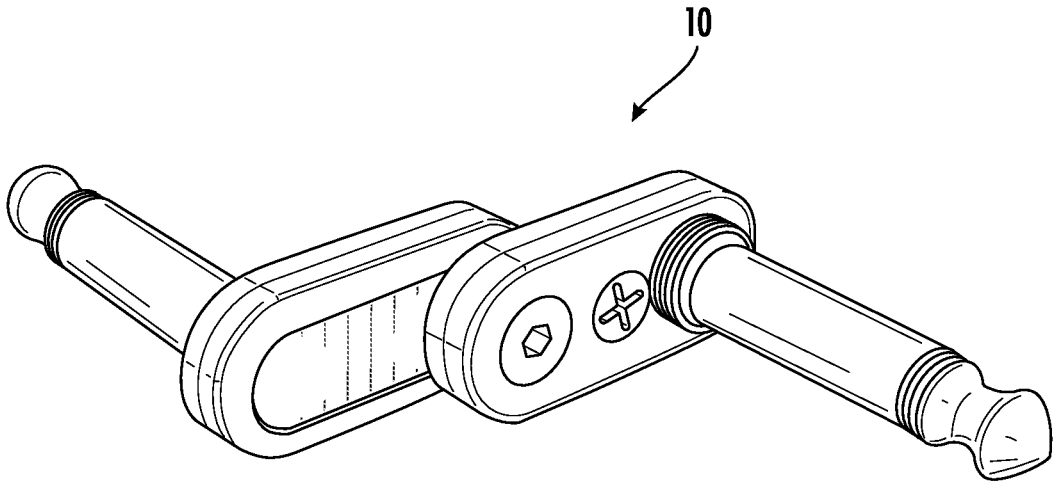
FIG. 1 shows an embodiment of the inventive adjustable plug adapter in perspective view.

Among the benefits and improvements disclosed herein, other objects and advantages of the disclosed embodiments will become apparent from the following wherein like numerals represent like parts throughout the several figures. Detailed embodiments of an adjustable signal plug adapter with pivoting functionality are disclosed; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrase "in some embodiments" as used herein does not necessarily refer to the same embodiment(s), though it may. The phrases "in another embodiment" and "in some other embodiments" as used herein do not necessarily refer to a different embodiment, although it may. Thus, as described below, various embodiments may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on.

Further, the terms "substantial," "substantially," "similar," "similarly," "analogous," "analogously," "approximate," "approximately," and any combination thereof mean that differences between compared features or characteristics is less than 25% of the respective values/magnitudes in which the compared features or characteristics are measured and/or defined.

With reference to the drawings wherein like numerals represent like parts throughout the Figures, an embodiment of the pivoting plug adapter 10 is shown. As shown, the adapter 10 includes two opposite plug sub-assemblies, 50 and 51, with respective plugs 12 and 13. Most of the features of the sub-assemblies will be described with reference to the first sub-assembly 50, however each sub assembly include substantially the same elements and characteristics. Thus, elements in the second sub-assembly 51 that are common with the first sub-assembly 50 are given reference numerals that are one unit higher (odd) than its like element in the first sub-assembly 50.

The sub-assembly 50 includes a laterally elongate housing 14 formed of two portions, 14*a* and 14*b*, that encloses a substantially flat signal coupler 34 and an insulation member 36 surrounding the signal coupler 34 within the housing. The housing 14 and signal coupler 34 extend laterally and a plug 12 extends in a longitudinal direction from the housing 14 near one lateral end. In this embodiment, the plug 12 comprises a central signal member 26 with an enlarged distal tip 40 with an elongate pin or shank 42 extending from it. In the embodiment shown in FIGS. 3 and 4, the pin 42 includes outer surface threading 52 on the end opposite the tip 40. As shown, the pin 42 is surrounded by a ground insulator 28 having an annular ring 38 at its front edge that abuts the tip 40 of the signal member 26 when assembled. As shown in FIG. 4, at least a portion of the threaded end 52 of the pin 42 is exposed from the ground insulator 28 within the housing 14 when assembled. A ground contact tube 30 surrounds the elongate portion of insulator 28 and abuts the ring 38 on the side opposite from the signal tip 40. Notably, the depicted plug 12 with configuration of the signal member 26, ground insulator 28 and ground contact tube 30 is a preferred type of plug for use within the pivoting adapter 10, but the inventive aspects of the adapter are not limited with respect to the particular plug or with respect to the specific configuration and relationship of the elements of a plug of the same type or for the same use. Additional embodiments exist that employ variations of this plug configuration, as will be discussed in detail below with respect to FIG. 8.

Figure 3:
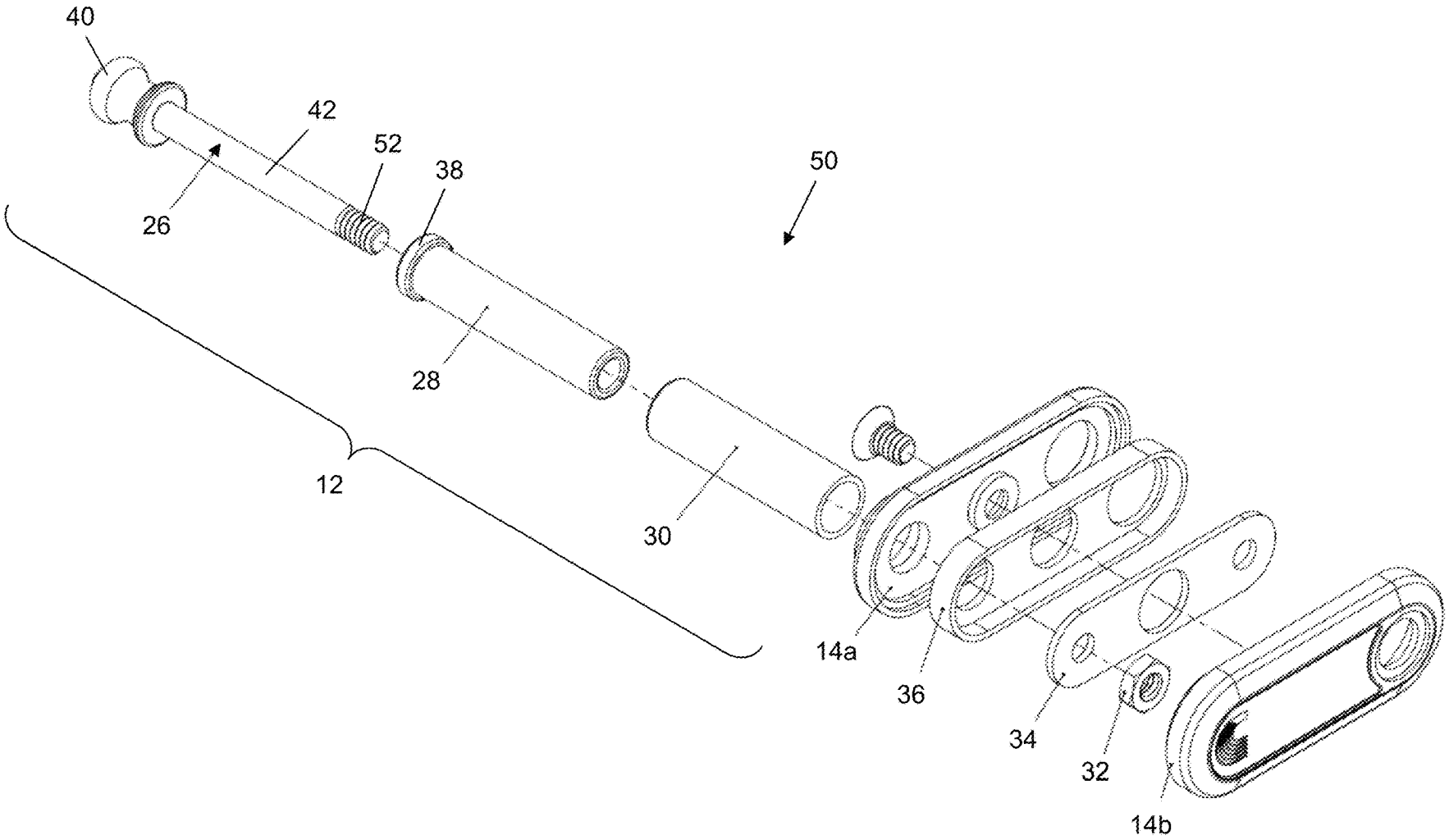
FIG. 3 is an exploded view of one sub-assembly of the adjustable plug adapter of FIG. 2.
Figure 4:
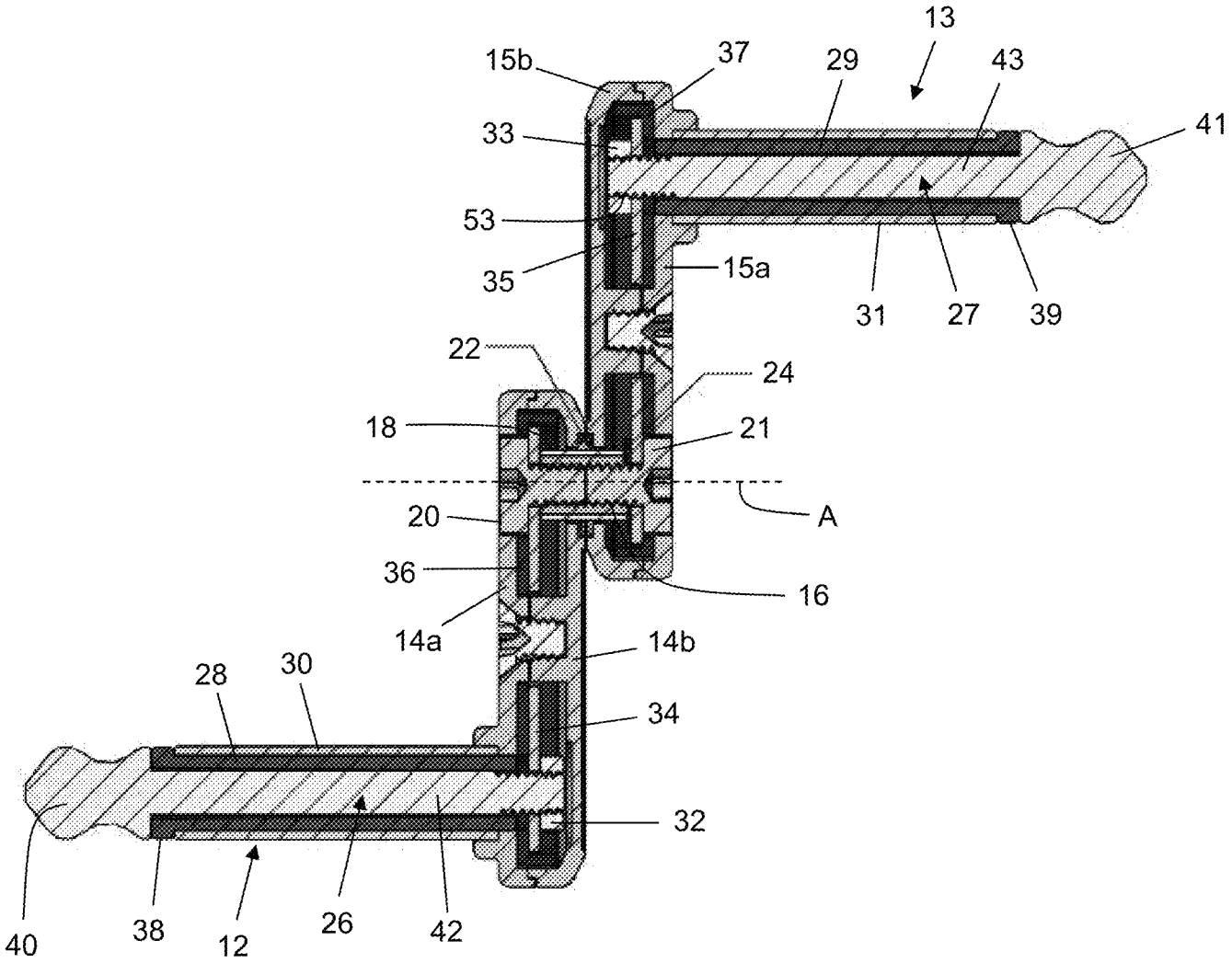
FIG. 4 is a section view of the adjustable plug adapter of FIG. 2.
Figure 5:
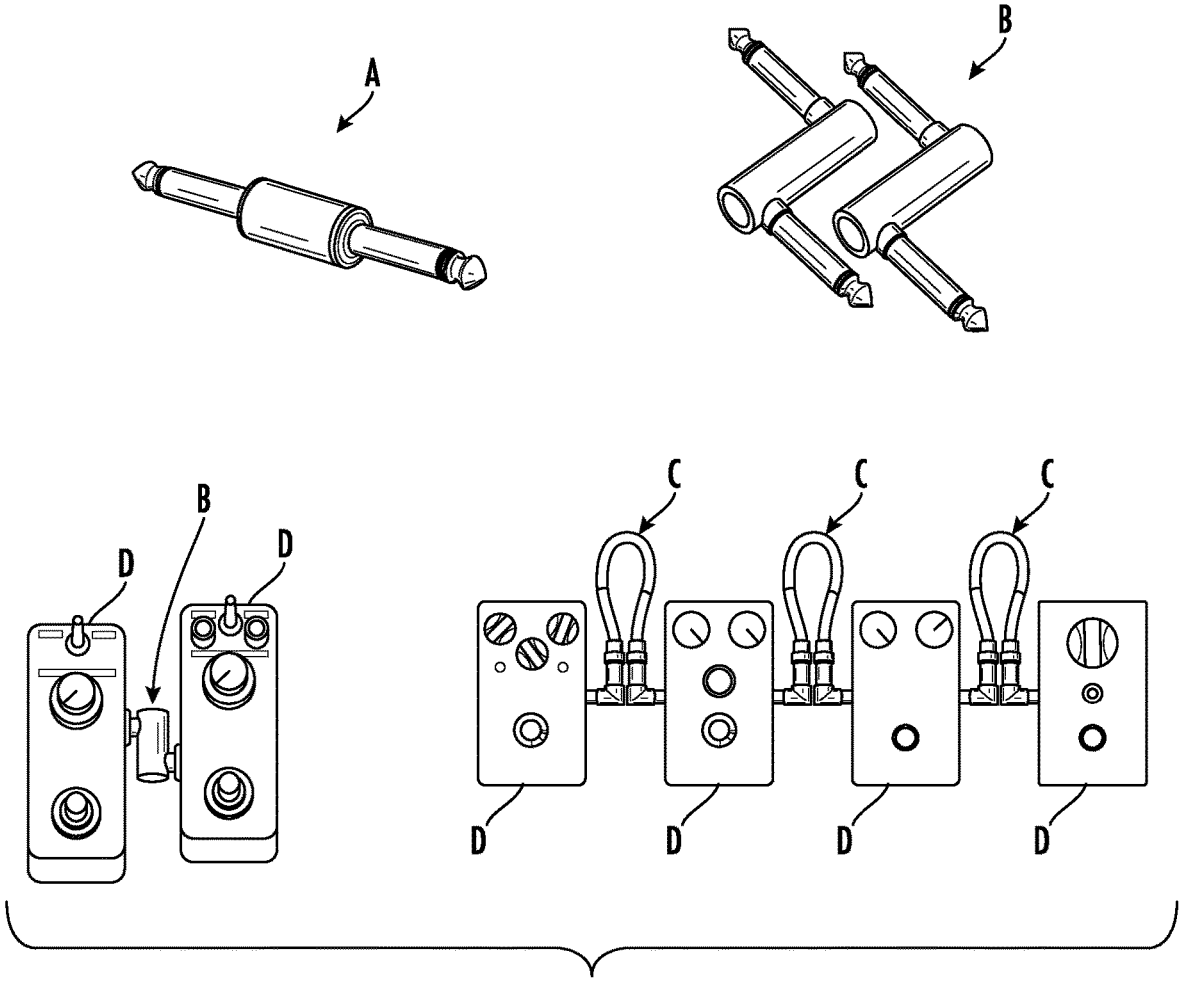
FIG. 5 shows a variety of adapters and pedal connection techniques as known in the prior art.

With reference to FIGS. 3 and 4, the threaded proximal end 52 of the pin 42 extends through a hole in the flat signal coupler 34 and is attached to the coupler 34 via a nut 32 on the opposite side of the signal coupler. The plug 12, signal coupler 34 and nut 32 are all made from a conductive metal to cooperate to form part of the conductive path for the audio signal. As noted above, an inner insulator 36 surrounds the edges of the signal coupler 34 within the housing 14. The housing may be held together via any common mechanical attachment method, such as the depicted central screw attaching the housing portions, 14*a* and 14*b*, to one another. An alternative to are housing portions with cooperative snapping members. As noted above, the second sub-assembly 51 is formed of most of the same elements and relationships as described with reference to the first sub-assembly 50. For clarity and completion, the substantially similar elements of the second sub-assembly 51 include:

| Ref. | Element |
|---|---|
| 13 | plug |
| 15; 15a, 15b | housing; housing portions |
| 27 | central signal member |
| 29 | ground insulator |
| 31 | ground contact tube |
| 35 | signal coupler |
| 37 | insulation member |
| 39 | annular ring of contact tube |
| 41 | signal member tip |
| 43 | signal member shank/pin |
| 53 | threaded portion |

The sub-assemblies are connected to one another in a pivoting relationship about a central axis A. As shown, the respective sub-assemblies, 14 and 15, are joined to one another through openings at their ends that are laterally opposite from their respective plugs, 12 and 13, at a substantially mid location of the plug 10. A central conductive pivot spacer 16 connects the sub-assemblies, 14 and 15, to one another. In this embodiment, the pivot spacer 16 is internally threaded on at least both longitudinal ends to receive a first screw 20 and second screw 21. A tubular sleeve 18 made from an insulating material surrounds the outer surface of the pivot spacer 16. The screws, 20 and 21, are typically conductive and combine with the signal members 26/27, signal couplers 28/29, nuts 32/33, pivot spacer 16 and a washer 24 (discussed below) to form a conductive path between the respective plugs 12/13. A portion of each of the flat signal couplers 28/29 is exposed for contact with the respective screw 20/21 when attached to provide a conductive path.

Figure 2:
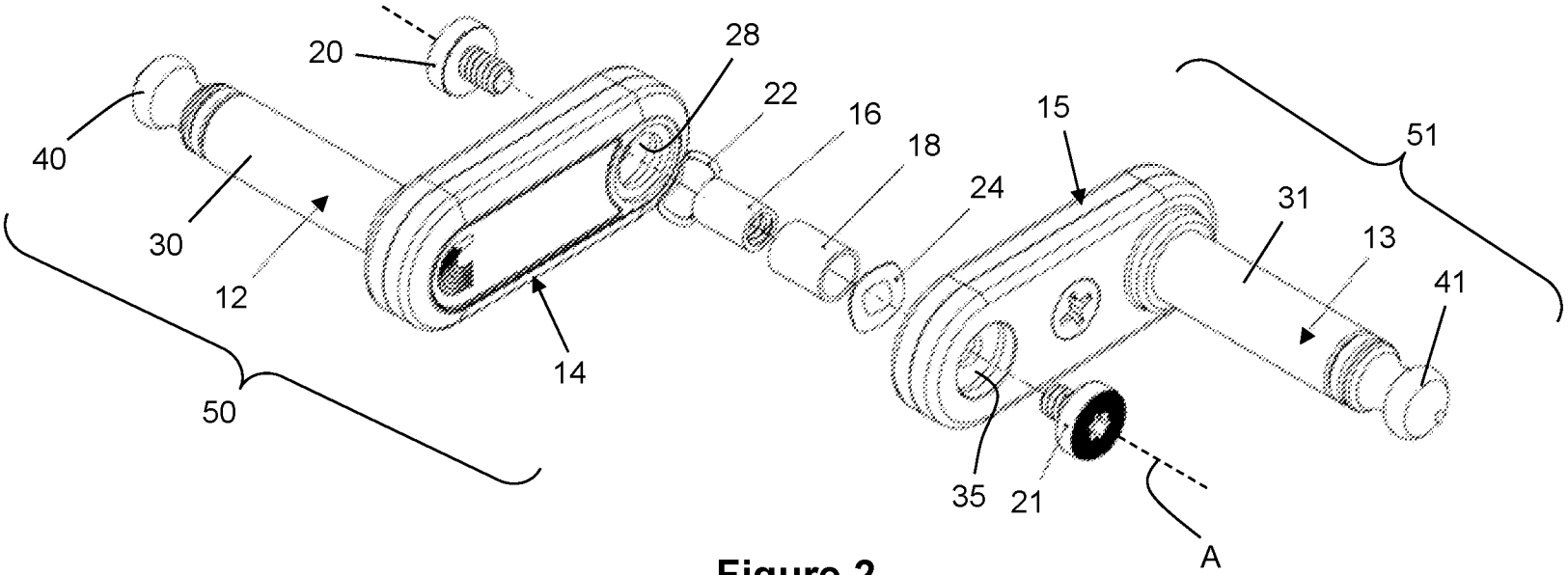
FIG. 2 is a partially exploded view of an embodiment of the disclosed adjustable plug adapter.
Figure 7:
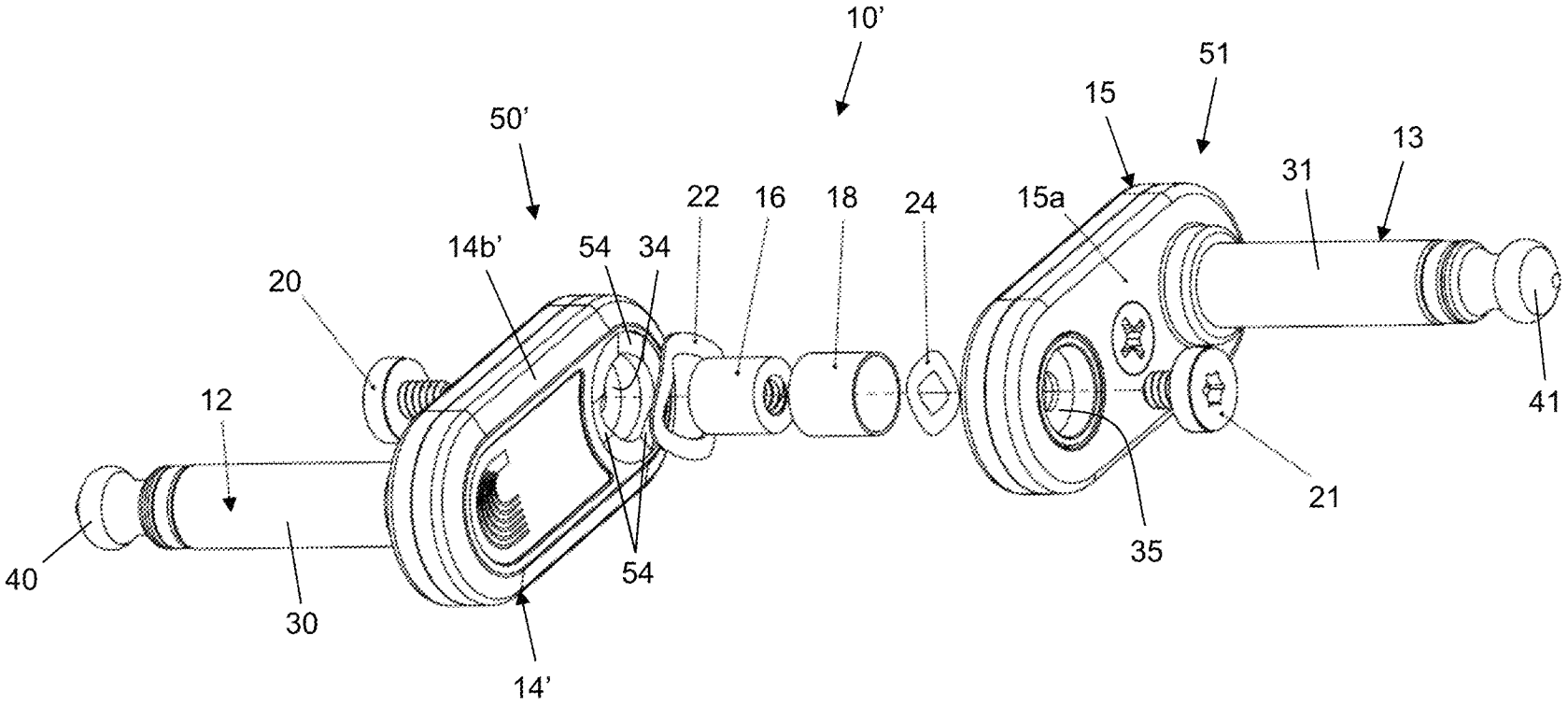
FIG. 7 shows a partial exploded view of an embodiment of the adjustable plug adapter.

As shown in FIGS. 2, 4 and 7, a first (large) wave washer 22 and second (small) wave washer 24 and are included substantially coaxial to the axis A (and pivot spacer 16, sleeve 18 and screws 20/21). When assembled, the large (ground) wave washer 22 circumscribes the sleeve 18 such that the sleeve 18 prevents contact between the large wave washer 22 and pivot spacer 16. The large wave washer 22 is positioned between and in abutment with the respective inner housing members, 14*b* and 15*b*. This assembled configuration is best understood with reference to the cross-sectional view of FIG. 4. In operation, the large washer 22 acts to transmit the ground connection between the respective sub-assemblies, 50 and 51, through the housings 14 and 15, as well as assist in providing a mechanically smooth rotation of the sub-assemblies relative to one another. The wave configuration of the washer acts to ensure that a connection is maintained to both sub-assemblies 50 and 51 at all times and provides a moderate bias on the sub-assemblies 50 and 51 away from each other to keep the interface between them tight.

FIG. 7 shows an embodiment of the pivoting plug adapter 10' that includes an alignment feature in the housing 14' of one of the sub-assemblies 50'. As can be seen, the first sub-assembly includes a plurality of relief notches 54 circumferentially spaced about the hole through which the conductive pivot spacer 16 extends to contact the signal coupler 34. The depiction includes three notches 54 in the inner housing member **14*b*' equiangularly spaced around the hole, however, this exact number and angular position is non-limiting. The notches 54 have shown useful in maintaining the large washer 22 in a preferred position angular orientation relative to the respective sub-assemblies 50' and 51. The remaining elements and sub-elements in this embodiment of the plug adapter 10' are the same as those in the plug adapter 10, and are thus identified in FIG. 7** with like reference numerals.

The small (conductor) wave washer 24 circumscribes the shank of the conductive screw 21 in a position between and in abutment with the signal coupler 29 and pivot spacer 16. In operation, the small washer 24 acts to transmit the audio signal from one sub-assembly 51 to the other sub-assembly 50 through the pivot spacer 16, while also contributing to the mechanically smooth rotation of the sub-assemblies relative to one another. Similar to the large washer 22 between the respective sub-assemblies 50 and 51, the small washer ensures a constant connection to both of the conductive pivot spacer 16 and one of the signal couplers, and provides a moderate outward bias between them, which ensures tight contact is maintained at all times and further assists smooth rotation of the sub-assemblies.

Notably, the wave washers are preferred contact and bias members for use within the inventive plug adapter 10. The wave washers have been shown to provide particularly strong stability and smooth rotation of the sub-assemblies while maintaining the conductive pathway between the respective plugs and separate insulative contact. Other embodiments of the plug adapter exist that utilize different bias members in place of one or both of the wave washers, 22 and 24. These alternate bias members can be different styles of springs or in the case of the large washer a resilient compressible material.

In a preferred embodiment, the signal screw 20 on the sub-assembly 50 (the sub-assembly without the small washer 24) is fully tightened via threading to the pivot spacer 16. The other signal screw 21 on sub-assembly 51 (the sub-assembly with the small washer 24) is not fully tightened. This configuration allows the sub-assembly 51 to pivot about the axis A to adjust the location of the opposite plugs, 12 and 13, relative to each other. In the depicted embodiment, the small washer 24 is positioned within the second sub-assembly 51 in abutment with the edge of the pivot spacer 16, however, the relative location could be reversed in different embodiments.

Figure 6:
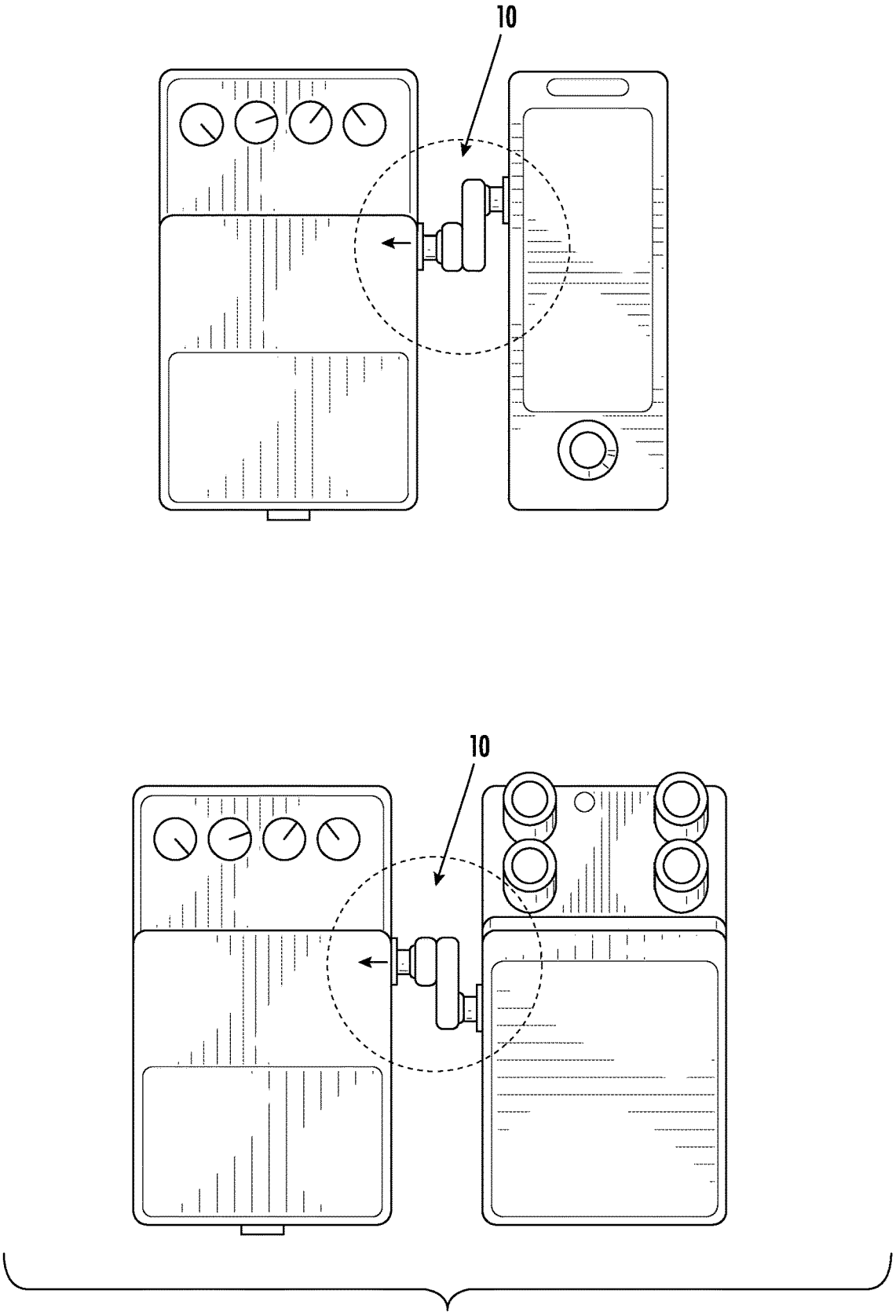
FIG. 6 show the inventive adjustable plug adapter in use connected to adjacent pedals.

The substantially flat (or thin) and laterally extending nature of the housings, 14 and 15, in the disclosed adapter 10 provide a very low profile relative to other signal adapters known in the field, while allowing adjustment of the lateral distance between the longitudinally extending plugs, 12 and 13, via the described pivoting action. This in turn provides adjustability for use in connecting a wide variety of effect pedals (or other audio equipment) with input and output jacks in countless locations. Moreover, the lateral adjustability via pivoting about axis A allows pedals to be placed in different locations relative to one another. FIG. 6 depicts examples of pedals connected via the disclosed adapter 10.

Preferably, the conductive elements are formed of a conductive metal such as one or more of silver, copper, gold, tin nickel or steel, or combinations thereof. Preferred materials for the non-conductive elements of the adapter 10 include all rigid and durable inert materials, such as for example resilient polymers, silicone materials and rubber.

Figure 8:
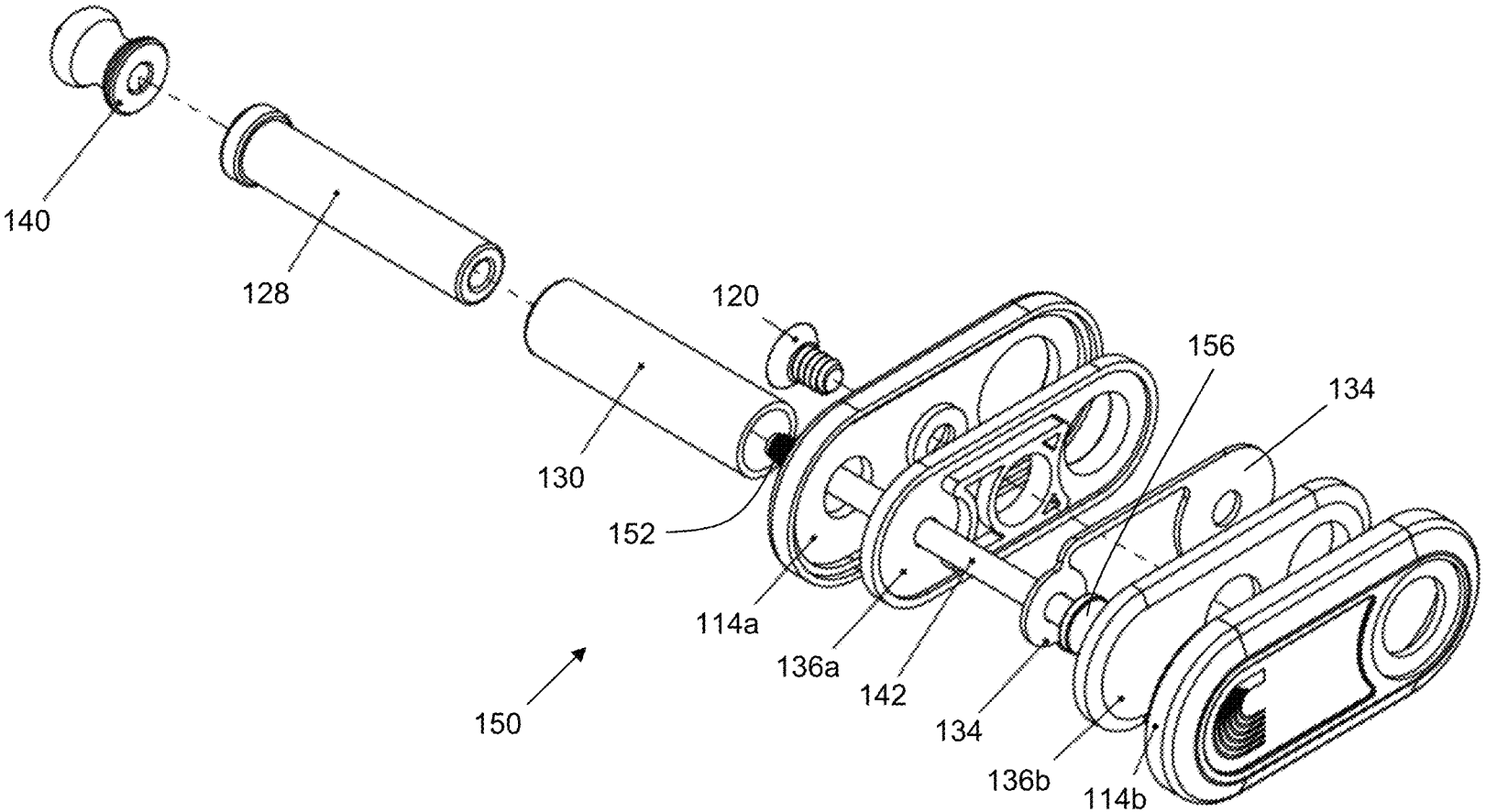
FIG. 8 is an exploded view of another embodiment of a sub-assembly of the adjustable plug adapter.
Figure 9:
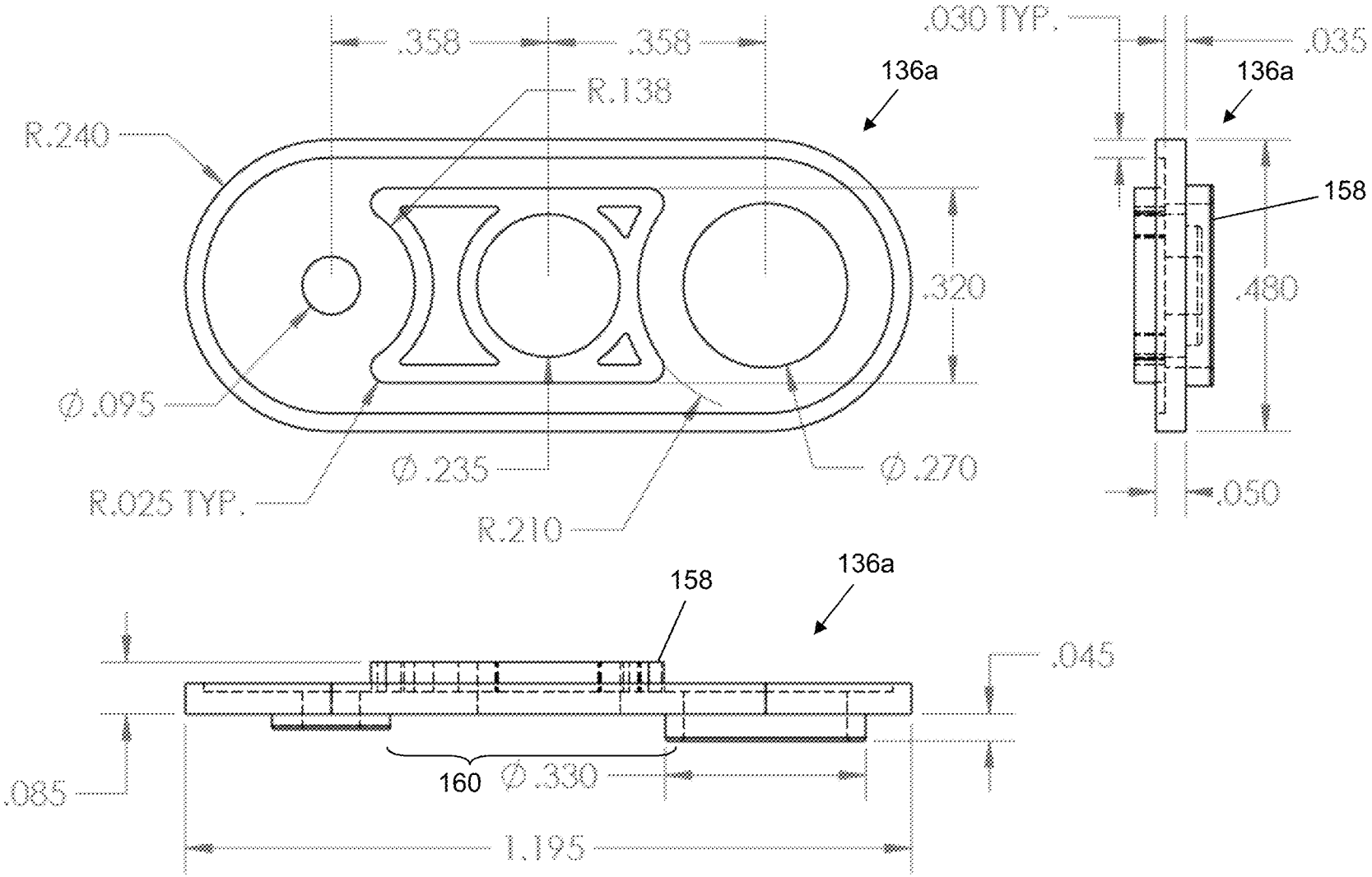
FIG. 9 shows a portion of the insulator of the sub-assembly of FIG. 8.

FIG. 8 shows another embodiment of a sub-assembly 150 for use within the disclosed inventive plug adapter. The over-all pivoting operation and use of wave washers, 22 and 24, to form constant contacts and allow pivoting of the plug adapter that employs such sub-assemblies 150 is the same as in the earlier embodiments. In the embodiment of FIG. 8, the plug is formed from a pin 142 with substantially flat radially-extending flange 156 on its inner side and a textured surface 152 (i.e., knurled) at the outer end. Unlike the earlier embodiments, the signal tip 140 is not initially formed integrally with the pin 142, but rather is a separate member that is pressed fit onto the knurled end 152 of the pin. Like the earlier embodiments, when assembled, the pin 142 extends through the ground insulator 128 with the ground contact tube 130 circumscribing the ground insulator. Instead of an inner nut as in the earlier embodiments, the flange 156 abuts the signal coupler 134 in a surface-to-surface contact ensuring constant conductive contact.

Additionally disclosed in FIG. 8 is another embodiment of an inner insulator that surrounds the signal coupler 134. In this embodiment, the inner insulator is formed of two portions, **136*a* and 136*b*, which thus fully surrounds the signal coupler 134 on all sides. As shown in the outer portion 136*a* of the inner insulator is fit with a shoulder 158 that surrounds the head of the housing attachment screw 120. Additional surface shoulders 160 are included which assist in tightly mating with the inner portion 136*b* of the insulator and aligning and securing the signal coupler 134. When assembled, the pin 142 is positioned with the flange 156 flat against the signal coupler 134 and extends through the outer insulator portion 136*a*, housing member 114, ground insulator 128 with outer ground contact tube 130 and is secured tightly in position with the signal tip 140 on the knurled end 152. The inner insulator 136*b* and other housing portion 114*b* are attached on the opposite end to sandwich the signal coupler 134 and pin flange 156 within the housing. While not depicted in FIG. 8, a second sub-assembly is attached in the same manner as in the earlier embodiments with a pivot spacer 16 providing conductive contact between the respective sub-assemblies and the coaxial wave washers, 22 and 24**, that provide mechanical integrity and constant conductive communication.

The inventive adapter provides a cable-free coupling assembly with plugs that are adjustable relative to one another so that a user can connect two effects pedals or other components having various jack locations. The pivoting assembly between the low profile sub-assemblies allows the user to line up pedals in any orientation with minimal distance between them.

The connectivity of the signal and the ground path is provided in the pivot assembly through a wave washer that acts as a spring-like bias member and provides a constant connection between conduction elements and another wave washer that also acts as a spring-like bias member and provides a constant connection between ground elements regardless of rotation or orientation. That is, the bias members serendipitously provide communicative connectivity and mechanical integrity to the plug device. The depicted flat and laterally extending geometry of the respective plug bodies is non-limiting to the inventive nature of the plug, but it is generally preferred to have a low profile which allows adjacent pedals or other components to be positioned very close together without the need for extra cable.

While a preferred embodiment has been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

What is claimed is:

1. A signal plug adapter, comprising:

a first sub-assembly comprising a first conductive plug;

a second sub-assembly comprising a second conductive plug and being connected to the first sub-assembly in a pivoting relationship about an axis A of rotation defining an axial direction;

a first wave washer positioned between the first sub-assembly and second sub-assembly substantially coaxial to the axis of rotation;

a second wave washer positioned within one of the first sub-assembly and second sub-assembly substantially coaxial to the first wave washer and the axis A of rotation; and a conductive pathway between the first conductive plug and the second conductive plug, wherein pivoting of the first and second sub-assemblies about the axis A adjusts the location of the plugs relative to one another, and one of the first and second wave washers is part of the conductive pathway between the first conductive plug and second conductive plug.

2. The plug adapter of claim 1, wherein each sub-assembly includes a conductive signal coupler within an insulating housing, and each plug includes a portion connected to a respective signal coupler in conductive communication.

3. The plug adapter of claim 2, wherein each plug comprises a shank with a flange on one end and an opposite end, wherein the shank is connected to the respective conductive signal coupler with the flange flat against the signal coupler and a signal tip secured to the opposite end.

4. The plug adapter of claim 3, wherein at least one of the plugs has an enlarged head on an end of the shank and a threaded section is on an end of the shank opposite the enlarged head.

5. The plug adapter of claim 1, comprising a bias member positioned between the first sub-assembly and the second sub-assembly that biases the first sub-assembly away from the second sub-assembly in a direction substantially along the axis A.

6. The plug adapter of claim 5, wherein the first wave washer is the bias member.

7. The plug adapter of claim 1, wherein the second wave washer is part of the conductive pathway between the first conductive plug and second conductive plug, and the first wave washer provides insulative contact between the first sub-assembly and second sub-assembly.

8. The plug adapter of claim 7, comprising a conductive pivot spacer substantially coaxial to the axis of rotation, wherein the pivot spacer extends between the first sub-assembly and second sub-assembly and is part of the conductive pathway between the first conductive plug and second conductive plug.

9. The plug adapter of claim 8, wherein the second wave washer is positioned within one of the first sub-assembly and second sub-assembly between an end of the pivot spacer and a signal coupler of the respective sub-assembly.

10. The plug adapter of claim 1, wherein the signal conductive pathway runs from the first plug in the first sub-assembly to a first signal coupler within a first insulating housing of the first sub-assembly to a wave washer within the first insulating housing to a conductive spacer sleeve between the first insulating housing and a second insulating housing of the second sub-assembly to a second signal coupler within the second insulating housing to the second plug.

11. The plug adapter of claim 10, wherein each signal coupler is substantially flat and elongated in a lateral direction transverse to the axis A of rotation within a housing of a sub-assembly.

12. The signal plug adapter of claim 1, wherein the first conductive plug and second conductive plug extend in opposite directions relative to one another at all rotational positions of the first and second sub-assemblies.

13. The signal plug adapter of claim 1, wherein the other of the first and second wave washers is not part of the conductive pathway.

14. The signal plug adapter of claim 1, wherein at least one of the plugs is a jack style plug.

15. A signal plug adapter, comprising:

a first sub-assembly comprising a first conductive plug;

a second sub-assembly comprising a second conductive plug and being connected to the first sub-assembly in a pivoting relationship about an axis A of rotation with a conductive pathway between the first conductive plug and the second conductive plug;

a conductive pivot spacer substantially coaxial to the axis of rotation, the pivot spacer extending between the first sub-assembly and second sub-assembly and being part of the conductive pathway between the first conductive plug and second conductive plug;

a spacer sleeve formed of an insulating material around the pivot spacer; and a wave washer around the spacer sleeve and contacting both the first sub-assembly and second sub-assembly, wherein pivoting of the first and second sub-assemblies about the axis A adjusts the location of the plugs relative to one another.

16. A signal plug adapter, comprising: a first sub-assembly comprising a first conductive plug; a second sub-assembly comprising a second conductive plug and being connected to the first sub-assembly in a pivoting relationship about an axis A of rotation defining an axial direction; a conductive pathway between the first conductive plug and the second conductive plug; pivoting of the first and second sub-assemblies about the axis A adjusts the location of the plugs relative to one another, and the first conductive plug and second conductive plug extend in opposite directions relative to one another at all rotational positions of the first and second sub-assemblies; comprising a first bias member between the first sub-assembly and second sub-assembly that biases the first sub-assembly and second sub-assembly away from one another, wherein the first bias member is not part of the conductive pathway.

17. The signal plug adapter of claim 16, comprising a second bias member for providing an bias force along the axis A, the second bias member being conductive and part of the conductive pathway.

18. The signal plug adapter of claim 17, wherein each of the first and second sub-assemblies includes a laterally extending housing that houses a laterally extending conductive signal coupler, wherein the conductive pathway extends from the first conductive plug through a first of the signal couplers, through the conductive second bias member, through the conductive pivot spacer, through a second of the signal couplers and to the second plug, and the first sub-assembly and second sub-assembly are pivotable about the axis A.

19. The signal plug adapter of claim 16, wherein at least one of the plugs is a jack style plug.

* * * * *